US005148974A

United States Patent [19]

Clapper

[11] Patent Number: 5,148,974

[45] Date of Patent: Sep. 22, 1992

[54] SECURITY MAIL BOX WITH IMPROVED ANTI-TAMPER MEANS

[76] Inventor: Millard Clapper, Terrace Dr., R.D. 3, Binghamton, N.Y. 13901

[21] Appl. No.: 806,379

[22] Filed: Dec. 13, 1991

[51] Int. Cl.[5] ..... A65D 91/00

[52] U.S. Cl. ..... 232/17; 232/31; 232/39; 232/43.1

[58] Field of Search ..... 232/17, 24, 25, 26, 232/30, 31, 32, 38, 39, 43.1, 43.3, 44, 45

[56] References Cited

U.S. PATENT DOCUMENTS

| | | | |
|---|---|---|---|
| 192,146 | 6/1877 | Bragaldi | 232/32 |
| 686,328 | 11/1901 | Plank | 232/32 |
| 811,611 | 2/1906 | Arsenault | 232/32 |
| 3,735,919 | 5/1973 | Morgan | 232/17 |
| 3,802,619 | 4/1974 | Vanderveer | 232/17 |
| 3,880,349 | 4/1975 | Earle | 232/17 |
| 4,844,332 | 7/1989 | Long | 232/17 |
| 4,993,626 | 2/1991 | Berry | 232/17 |
| 5,071,063 | 12/1971 | Overstreet | 232/17 |

*Primary Examiner*—Renee S. Luebke
*Assistant Examiner*—F. Saether
*Attorney, Agent, or Firm*—Charles S. McGuire

[57] ABSTRACT

A security mailbox including an upper compartment for conventional and a lower compartment for secured deposit of mail. An interior partition includes a rear portion movable about a hinged connection to a fixed, front portion between a horizontal position, wherein the partition substantially entirely separates the upper and lower compartments, and a lowered position, wherein the movable portion extends into the lower compartment and permits mail deposited in conventionl fashion in the upper compartment to fall into the lower compartment from which it may be removed only by authorized persons through a normally locked door. the apparatus is characterized by the absence of any structure inside the housing which could interfere with normal deposit of mail, and by a lockable support permitting movement of the portion of the partition from its lowered to its horizontal position only by authorized persons.

16 Claims, 2 Drawing Sheets

SECURITY MAIL BOX WITH IMPROVED ANTI-TAMPER MEANS

BACKGROUND OF THE INVENTION

The present invention relates to novel and improved deposit and collection receptacles, such as mailboxes, and more specifically to security mailboxes having a first, upper compartment of a type approved by the United States Postal Service for receiving mail in the typical fashion, and a second, selectively useable, lower compartment to which only authorized persons have access.

Various types of mailboxes and other such depositories have been in use for many years. Typically, mailboxes are seen mounted along roadways or in or upon a wall or door of a home for delivery and pickup of mail. Conventional mailboxes are designed for easy access to the interior. Unfortunately, these conventional mailboxes are also easily accessible to unauthorized persons. Therefore, such conventional mailboxes leave one's mail susceptible to theft, vandalism, and lack of privacy.

A second problem with conventional mailboxes is that when one is away from home for several days or weeks, mail which is delivered daily tends to accumulate inside. This accumulation of mail not only jams up the mailbox, but is also a signal to burglars and/or vandals that no one is home, thus leaving a person's mail and mailbox susceptible to theft and/or vandalism. One solution to this problem is to stop mail delivery for the period of absence or to have a neighbor pick up your mail. However, this is not always possible or practical.

In such circumstances it would be desirable to have a mailbox with a locked storage compartment in which the mail may accumulate out of reach and sight of prospective burglars and vandals during periods of absence. Additionally, it would be desirable to be able to receive and send mail in the conventional manner when at home. Furthermore, it would be desirable to allow only authorized persons the option of converting the mailbox between the two aforementioned positions.

The desirability of mail security in receptacles convertible between conventional and secured reception has been previously recognized, and a number of designs have been proposed. U.S. Pat. No. 4,724,999 of Fitzgerald et al discloses a mailbox having an upper compartment accessible through an unsecured door at the front. A forward portion of the upper compartment floor is hingedly attached to a fixed, rear portion to permit movement of the forward portion to a raised position, in which it is releasably secured by catch means within the upper compartment. When the forward portion of the upper compartment floor is in the raised position, mail drops through the opening thus provided to a lower compartment, accessible through a normally locked door. Among the disadvantages of this security mailbox are the protrusions within the upper compartment formed by the catch means, and the easy accessibility of the catch means, i.e., unauthorized persons may easily move the upper compartment floor from the raised to the lowered position, thus defeating the purpose of the security provisions.

A second design of security mailbox is disclosed in U.S. Pat. No. 4,793,551 of Baylor. The upper compartment of this mailbox also includes a hinged portion of the floor with releasable catch means in the upper compartment. Thus, the design of this patent suffers from the same disadvantages as that of U.S. Pat. No. 4,724,999.

In U.S. Pat. No. 4,993,626 a security mailbox includes a pivotally and laterally movable shelf which partially separates upper and lower portions of the receptacle, respectively accessible through non-secured and lockable doors. This design requires actuation of the movable shelf by the mail delivery person, an unacceptable constraint by current standards.

It is therefore a principal object of the present invention to provide a novel and improved security mailbox, which may be selectively converted between conventional and security mail receiving conditions.

It is another object of the present invention to provide a convertible security mailbox which only authorized persons may convert from a security to a conventional mail receiving mode.

It is still another object of the present invention to provide a convertible mailbox having an upper compartment with a floor selectively movable to a lowered position for deposit of mail in a secured, lower compartment with no obstructing internal structures.

Other objects will in part be obvious and will in part appear hereinafter.

SUMMARY OF THE INVENTION

In the disclosed, preferred embodiment, the apparatus of the invention comprises a housing defining a first, upper compartment, preferably a standard, U.S. Postal Service approved mailbox, separated from a second, lower compartment by the floor of the standard mailbox. A portion of the floor forms a hinged partition which is alternatively held in a first, horizontal position by a screw pin or in a second, lowered position, wherein the upper and lower compartments communicate, by a chute stop.

When the partition is in its first, horizontal position, mail may be deposited in the upper compartment in the conventional manner through a freely opened door on the front. A threaded nut welded on the outwardly facing surface of the rear wall of the housing provides means for the screw pin to be moved inwardly under the rear edge of the partition, supporting it in a horizontal position, or outwardly to allow the partition to move to its lowered position. The screw pin has a flat head so that it cannot be removed from the apparatus, but does not interfere with movement of mail from the upper to the lower compartment. A through, lateral opening in the pin permits placement of a lock structure so that when the partition is in its second, lowered position the pin cannot be moved back to its supporting position until the lock structure is removed.

When the partition is in its lowered position, mail deposited in the upper compartment slides down the partition into the second, lower compartment. This compartment has a normally locked door and is large enough to allow a relatively large quantity of mail to accumulate. This provides security and privacy to one's mail, particularly when away from home for a prolonged duration. The lockable door permits access to the lower compartment only by authorized persons, and the partition may be placed in the horizontal position for conventional mail reception only by authorized persons. As used herein, "authorized persons" means someone having access to the means for releasing the lock structure associated with the lower compartment access door and/or the screw pin or equivalent support means. The lowered partition rests on a chute stop which keeps the mail out of both reach and sight of potential burglars and vandals.

The structure and operation of the present invention will be more fully understood from the following detailed description of the preferred embodiment, taken in conjunction with the accompanying drawings.

DETAILED DESCRIPTION

Figure 1:
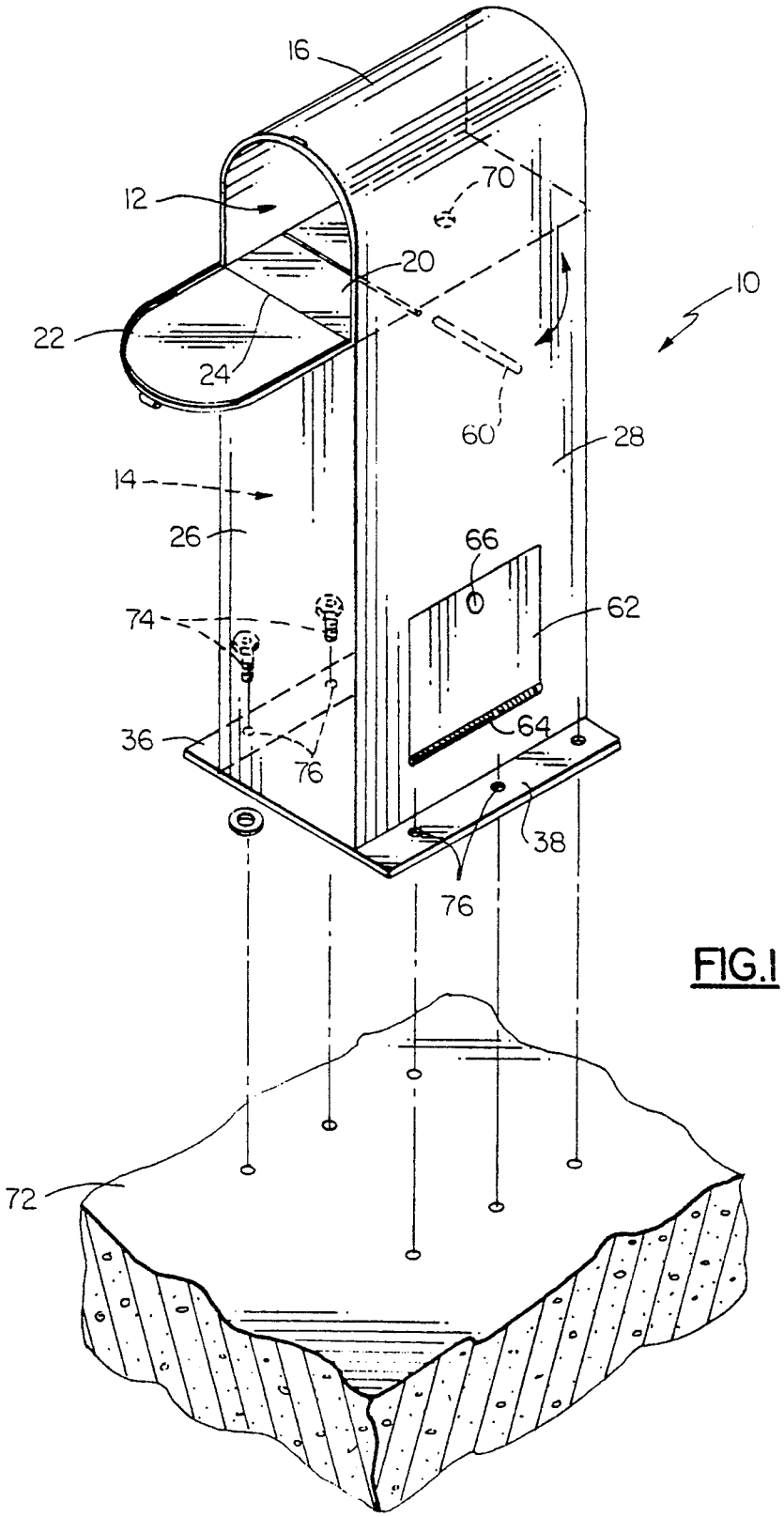
FIG. 1 is a perspective view of the apparatus of the invention, shown in spaced relation to a fixed slab upon which it may be mounted.

Referring now to the drawings, the apparatus of the invention comprises a housing, denoted generally by reference numeral 10, having upper and lower compartments 12 and 14, respectively. The portion of housing 10 forming upper compartment 12 may conveniently comprise a traditional or contemporary box style constructed to standards for the manufacture of rural mailboxes prescribed by Delivery Equipment Division, U.S. Postal Service. As such, the portion of housing 10 enclosing upper compartment 12 comprises curved wall 16, forming the top and two sides, rear wall 18, lower wall or floor 20 and front wall 22, hingedly connected along its lower edge 24 to floor 20 to provide a freely openable and closable door at the front of upper compartment 12.

The portion of housing 10 forming lower compartment 14 is of substantially rectangular cross section, comprising front wall 26, side walls 28 and 30, rear wall 32 and bottom wall 34 which extends past side walls 28 and 30 to form laterally extending flanges 36 and 38. The upper and lower portions of housing 10 are unitized by welding or otherwise permanently joining the lower edges of walls 16 and 18 to the upper edges of walls 26, 28, 30 and 32. The conventional mailbox forming the upper portion of housing 10 is modified by making all or part of floor 20 hingedly movable from its normal, horizontal position to an angular position with its rear edge lowered inside lower compartment 14. In the illustrated design, floor 20 is divided into front and rear sections 40 and 42, respectively, connected by hinge 44. Front section 40 is considerably shorter than rear section 42, as seen in FIGS. 2 and 3, preferably extending no more than about 3 inches from its front edge to hinge 44.

Front section 40 remains fixedly attached at its sides to wall 16, while rear section 42 is freely movable about hinge 44. Nut 46 is welded or otherwise fixedly attached to rear wall 32 in alignment with an opening therein. Screw pin 48 is threaded through nut 46 and extends through the opening in wall 32. Manually engageable head 50 and relatively thin, washer-like head 52 are provided on the outer and inner ends, respectively, of screw pin 48, and transverse openings 54 and 56 are drilled therethrough.

Figure 3:
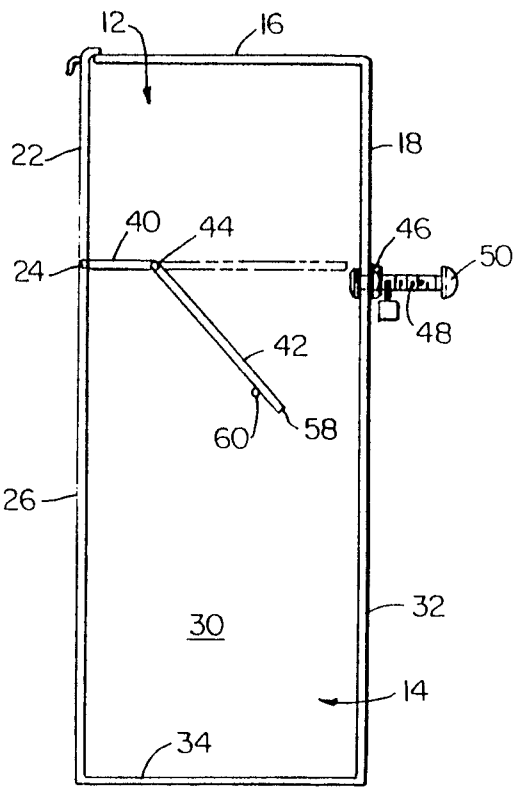
FIGS. 2 and 3 are sectional, side elevational views of the apparatus of FIG. 1, showing the movable partition thereof in its two alternative positions.
Figure 4:
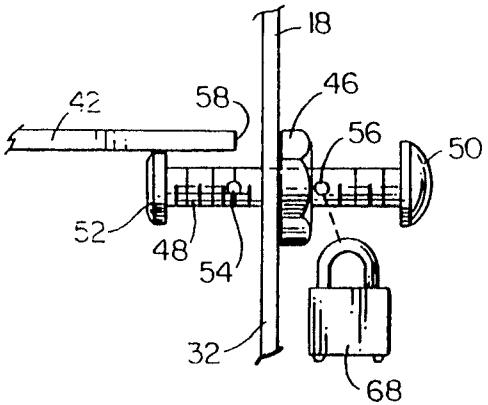
FIGS. 4 and 5 are enlarged, fragmentary portions of FIGS. 2 and 3.
Figure 2:
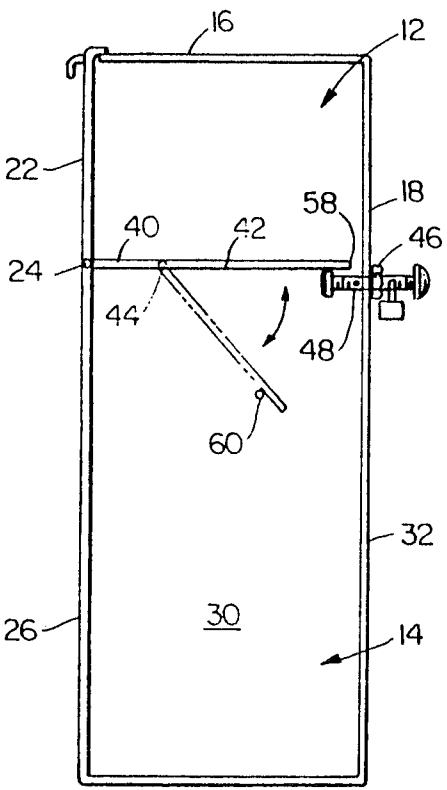

When mail is deposited for pick-up, and when mail is to be received in conventional fashion, in upper compartment 12, rear section 42 of floor 20 is maintained in a horizontal position with its lower surface resting upon head 52, as shown in FIGS. 2 and 4. When it is desired to receive mail in lower, secure compartment 14, screw pin 48 is threaded through nut 46 until head 52 engages the inside of wall 32, as in FIGS. 3 and 5. A small clearance between rear edge 58 of rear section 42 and the inner surfaces of walls 18 and 32 permits the rear section t move about hinge 44 until it comes to rest against fixed support 60, extending laterally across lower compartment 14 between side walls 28 and 30. Mail may be removed from lower compartment 14 through door 62, hingedly connected at 64 to side wall 28 and normally secured by lock 66 (FIG. 1).

Figure 5:
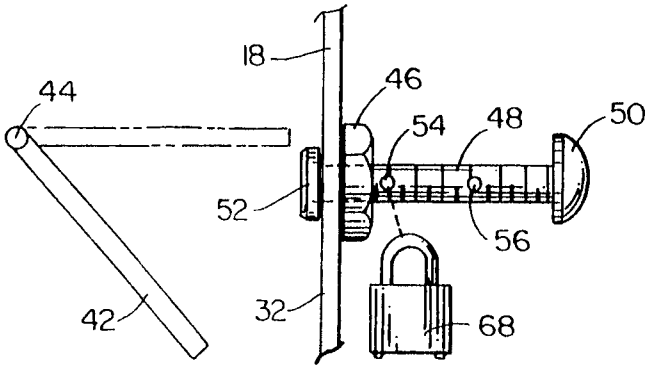

When screw pin 48 is in its outer position, with rear section 42 of floor 20 lowered, as in FIGS. 3 and 5, padlock 68 may be inserted through opening 54 and locked. This provides added security by preventing unauthorized persons from placing rear section 42 back in its horizontal position. When padlock 68 is removed by a person having the key, rear section 42 may be lifted to a position at or above horizontal by inserting a finger through hole 70 (FIG. 1), and screw pin 48 threaded through nut 46 until section 42 will again rest upon head 52. Padlock 68 may then be placed in opening 56 of screw pin 48. Although it is possible to withdraw the screw pin to allow section 42 to move to its lower position when padlock 68 is in opening 56, this simply converts mail reception from conventional (upper compartment) to secured (lower compartment), and not the undesirable opposite.

Housing 10 is preferably anchored to a secure support, such as slab 72, by bolts 74 passing through openings 76 in flanges 36 and 38 and secured in the slab. Also, a conventional signal flag (not shown) would normally be provided outwardly adjacent one side of the upper compartment.

From the foregoing it will be seen that the invention provides the stated objects and advantages through structure which permits conversion from secured to conventional mail reception only by authorized persons. Furthermore, the structure is such that mail deposited in the upper compartment in conventional fashion by the delivery person is assured of falling into the lower compartment when the structure is in security mode position. There are no protrusions or other structure in the upper compartment which could interfere with either conventional or security mail deposit.

What is claimed is:

1. A security mailbox for deposit of mail in selectively alternative conventional and security modes, said mailbox comprising:

a) housing means having walls enclosing upper and lower compartments, said walls including first and second doors movable to permit and prevent access to the interiors of said upper and lower compartments, respectively;

b) a partition within said housing, at least a portion of said partition being movable between a first, substantially horizontal position, wherein said partition separates said upper and lower compartments, and a second position, providing an opening through which said upper and lower compartments communicate;

c) support means selectively movable between a supporting position, wherein said support means holds said portion of said partition in said first position thereof, and a non-supporting position, permitting movement of said portion of said partition to said second position thereof, said support means including an external threaded elongated member extending through one of said walls and having a manually engageable portion outside said housing and a supporting portion inside said housing, said manually enageable portion being reciprocally movable by engagement with an internally threaded element affixed to said one wall to effect movement of said supporting portion between said supporting and non-supporting positions;

d) first lock means permitting movement of said second door to permit access to said lower compartment only by authorized persons; and e) second lock means permitting movement of said support means from said non-supporting to said supporting position only by authorized persons, said second lock means including a structural member selectively positionable adjacent the exterior of said one wall to prevent movement of said manually engageable portion to effect movement of said support portion to said supporting position.

2. The security mailbox of claim 1 wherein said partition, when in said horizontal position, forms a floor of said upper compartment.

3. The security mailbox of claim 2 wherein said floor has parallel front and rear edges, and said portion of said partition is movable about an axis parallel to said front and rear edges.

4. The security mailbox of claim 3 wherein said portion of said partition is positioned substantially entirely within said lower compartment when in said second position.

5. The security mailbox of claim 1 wherein said one wall is a wall of said lower compartment.

6. The security mailbox of claim 5 wherein said upper and lower compartments include vertically adjacent, co-planar rear walls, and said one wall is said lower compartment rear wall.

7. The security mailbox of claim 1 wherein said elongated member includes at leas tone transverse, through opening, and said structural member is selectively insertable through said through opening when said support means is in said non-supporting position and is removable upon actuation of said second lock means by an authorized person.

8. A security mailbox comprising:

a) an upper compartment enclosed on the sides, top and rear by fist fixed wall means and one the front by a first door freely movable between open and closed positions;

b) a lower compartment positioned directly below said upper compartment and enclosed on the sides, front and rear by second fixed wall means;

c) a generally planar partition having front, rear and side edges, at lease a proton of said partition including said rear edge being pivotally movable about an axis parallel to said rear edge between a substantially horizontal position, wherein said partition extends substantially between said sides, top and rear of said upper compartment to separate the latter from said lower compartment, and a lowered position, wherein said portion is positioned within said lower compartment for communication of said upper and lower compartments, whereby mail deposited in said upper compartment through said first door falls into said lower compartment;

d) a second door in one of said second wall means through which the interior of said lower compartment is accessible;

e) lock means for said second door to permit opening thereof only by authorized persons; and f) support means movable between a supporting position, wherein said support means holds said portion of said partition in said horizontal position, and a non-supporting position, permitting movement of said portion of said partition to said lowered position, said support means comprising a screw pin threadedly engaged with a nut fixedly attached to said second wall means on the rear of said lower compartment, said screw pin extending through said second wall means and including a manually engageable portion outside and a support portion inside said lower compartment, said manually engageable portion being selectively movable to effect movement of said support portion between said supporting and non-supporting positions.

9. The security mailbox of claim 8 and further including supplemental lock means permitting movement of said support means from said non-supporting to said supporting position only by authorized persons.

10. The security mailbox of claim 9 wherein said support means comprises an elongated member extending through an opening in said second wall means and having a manually engageable portion outside and supporting portion inside said lower compartment, said manually engageable portion being movable to effect longitudinal movement of said elongated member between said supporting and non-supporting positions of said support portion.

11. The security mailbox of claim 10 wherein said elongated member includes an opening extending laterally therethrough, and said supplemental lock means comprises structure insertable in said opening when said member is in said non-supporting position to block movement to said supporting position until said structure is removed from said opening.

12. The security mailbox of claim 8 wherein said partition is divided by a hinged connection at said axis between a fixed portion, extending from said front edge to said axis, and a movable portion extending from said hinge to said rear edge, said axis being closer to said front edge than to said rear edge.

13. The security mailbox of claim 12 and further including a fixed support within said second compartment upon which said portion of said partition rests and is supported at an acute angle to the horizontal while in said lowered position.

14. The security mailbox of claim 13 wherein said support means comprises an elongated member extending through an opening in the rear of said second wall means and having a manually engageable portion outside and a support portion inside said second compartment, means for preventing complete withdrawal of said member from said opening, and supplemental lock means operative to prevent movement of said support means from said non-supporting to said supporting position until actuation of said lock means by an authorized person.

15. A security mailbox comprising:

a) an upper compartment enclosed on the sides, top and rear by first fixed wall means and one the front by a first door freely movable between open and closed positions;

b) a lower compartment positioned directly below said upper compartment and enclosed on the sides, front and rear by second fixed wall means;

c) a generally planar partition having front, rear and side edges, at least a portion of said partition being pivotally movable about an axis parallel to said rear edge between a substantially horizontal position, wherein said partition extends substantially between said sides, top and rear of said upper compartment to separate the latter from said lower compartment, and a lowered position, wherein said portion is positioned within said lower compartment for communication of said upper and lower compartments, whereby mail deposited in said upper compartment through said first door falls into said lower compartment;

d) a second door in one of said second wall means through which the interior of said lower compartment is accessible;

e) lock means for said second door to permit opening thereof only by authorized persons;

f) an elongated ember movable between a supporting position, wherein said elongated member holds said portion of said partition in said horizontal position, and a non-supporting position, permitting movement of said portion of said partition t said lowered position, said elongated member extending through an opening in said second wall means and having a manually engageable portion outside and a supporting portion inside said lower compartment, said manually engageable portion being movable to effect longitudinal movement of said elongated member between said supporting and non-supporting positions of said support portion; and g) supplemental lock means permitting movement of said elongated member from said non-supporting to said supporting position only by authorized persons;

h) said elongated member having an opening extending laterally therethrough, sand said supplemental lock means comprising structure insertable in said opening when said member is in said non-supporting position to block movement to said supporting position until said structure is removed from said opening.

16. A security mailbox comprising:

a) an upper compartment enclosed on the sides, top and rear by first fixed wall means and on the front by a first door freely movable between open and closed positions;

b) a lower compartment positioned directly below said upper compartment and enclosed on the sides, front and rear by second fixed wall means;

c) a generally planar partition having front, rear and side edges, a first portion of said partition, extending from said front edge to said axis, being fixed and a second portion extending from said hinge to said rear edge, being pivotally movable about a hinged connection at an axis parallel to a said rear edge and closer to said front edge than to said rear edge between a substantially horizontal position, wherein said partition extends substantially between said sides, top and rear of said upper compartment to separate the latter from said lower compartment, and a lowered position, wherein said portion is positioned within said lower compartment for communication of said upper and lower compartments, whereby mail deposited in said upper compartment through said first door falls into said lower compartment;

d) a second door is one of said second wall means through which the interior of said lower compartment is accessible;

e) lock means for said second door to permit opening thereof only by authorized person; and f) an elongated member movable between a supporting position, wherein said elongated member holds said portion of said partition in said horizontal position, and a non-supporting position, permitting movement of said portion of said partition to said lowered position, said elongated member extending through an opening in the rear of said second wall means and having manually engageable portion outside and a support portion inside said second compartment, means for preventing complete withdrawal of said member from said opening, and supplemental lock means operative to prevent movement of said support means from said non-supporting to said supporting position unit actuation of said lock means by an authorized person.

* * * * *